US009044092B1

(12) United States Patent
Lee

(10) Patent No.: US 9,044,092 B1
(45) Date of Patent: Jun. 2, 2015

(54) HOOK ATTACHMENT SLING CHAIR

(71) Applicant: Clifton Shao-ming Lee, Hillsborough, CA (US)

(72) Inventor: Clifton Shao-ming Lee, Hillsborough, CA (US)

(73) Assignee: NUMARK INDUSTRIES COMPANY LIMITED, Hung Hom (CN)

( * ) Notice: Subject to any disclaimer, the term of this patent is extended or adjusted under 35 U.S.C. 154(b) by 0 days.

(21) Appl. No.: 13/987,554

(22) Filed: Aug. 6, 2013

(51) Int. Cl.
*A47C 4/02* (2006.01)
*A47C 3/00* (2006.01)

(52) U.S. Cl.
CPC .... *A47C 4/02* (2013.01); *A47C 3/00* (2013.01)

(58) Field of Classification Search
CPC ..... A47C 4/02; A47C 4/03; A47C 4/021; A47C 4/024; A47C 3/00
USPC ..... 297/440.23, 440.22, 446.1, 446.2, 297/448.1, 452.13, 188.1, 335
See application file for complete search history.

(56) References Cited

U.S. PATENT DOCUMENTS 3,393,941 A * 7/1968 Grosfillex ..... 297/440.22
4,583,782 A * 4/1986 Mikuniya ..... 297/440.22
4,892,355 A * 1/1990 Fend ..... 297/440.22
5,064,247 A * 11/1991 Clark et al. ..... 297/447.3
5,375,914 A * 12/1994 Donnelly ..... 297/335
5,507,563 A * 4/1996 Arthur, Jr. ..... 297/440.23
5,716,101 A * 2/1998 Frinier et al. ..... 297/440.22
6,517,161 B2 * 2/2003 Lo ..... 297/440.11
6,883,854 B2 * 4/2005 Daniel ..... 296/65.03
6,935,698 B1 * 8/2005 Chen ..... 297/440.22
7,331,628 B2 * 2/2008 Lin ..... 297/16.2
7,452,033 B2 * 11/2008 Ma et al. ..... 297/336
7,708,349 B2 * 5/2010 Chen ..... 297/448.1
7,758,122 B2 * 7/2010 Haida et al. ..... 297/336
2003/0164639 A1 * 9/2003 Infanti ..... 297/440.1
2004/0108767 A1 * 6/2004 Zhao ..... 297/440.22
2009/0273211 A1 * 11/2009 Hancock et al. ..... 297/13
2011/0089739 A1 * 4/2011 Huang ..... 297/440.23

* cited by examiner

*Primary Examiner* — David R Dunn
*Assistant Examiner* — Timothy J Brindley
(74) *Attorney, Agent, or Firm* — Daniel Hopen

(57) ABSTRACT

Some embodiments of the present invention provide an apparatus for a novel hook attachment sling chair. The hook attachment sling chair simplifies the manufacture and assembly of sling chairs affording easier construction and assembly. The sling chair comprises a chair frame having two pairs of legs with a first cross member coupled to a first pair of legs and a second cross member coupled to a second pair of legs, the first cross member includes a pair of hooks fastened to an angular surface of the first cross member, the second pair of legs each includes an attachment point configured to receive a fastener bolt. A sling seat section has two frame rails each frame rail includes a pin protruding from an interior side of the frame rail configured to attach to the hooks fastened to the first cross member wherein each frame rail includes another attachment point having a threaded section configured to receive the fastener bolt and secure each frame rail at the another attachment point to the attachment point at each of the second pair of legs.

19 Claims, 3 Drawing Sheets

HOOK ATTACHMENT SLING CHAIR

BACKGROUND

1. Technical Field

This disclosure generally relates to sling chairs, and more particularly to attaching a sling seat section to a chair base wherein attachment to the chair base is greatly simplified.

2. Related Art

Conventional outdoor furniture of the type intended for use on decks and patio are very popular. Manufacturers of outdoor patio furniture are constantly called upon to offer new innovative designs that provide practical, comfortable products to the consumer. Manufacturers on one hand are interested in offering the innovative designs, but are also interested in reducing manufacturing cost by simplifying and reducing the time to manufacture and assembly of the outdoor patio furniture.

As the outdoor patio furniture industry has developed, a popular design for chairs, loungers, and the like is a supporting web that is suspended between a frame of a chair to support the user of the chair. These supporting web style chairs are commonly known as sling chairs. Sling chairs are very popular since the chairs are very comfortable and durable. The sling construction enables the chairs to be strong and light.

Typically, sling chairs are packaged and transported from the place of manufacturer to the final destination disassembled. In general, the sling chair has a frame base and a seating section. Many techniques have been used to assemble the sling chair. However, efficiency and cost effectiveness dictate reduction in parts, reduction in high tolerance requirement during manufacture, and ease of assembly for the design and manufacture of sling chairs. Accordingly, it has become apparent that there are economic short comings with current construction and manufacture of sling-style chairs.

What is needed is a sling chair that simplifies conventional sling chair assembly while reducing effort associated with the manufacture and construction of the sling chair.

SUMMARY OF INVENTION

An apparatus for a novel hook attachment sling chair is disclosed which overcomes disadvantages of previous sling chair construction. The novel hook attachment sling chair construction alleviates some of the tight manufacturing tolerances associated with the manufacture sling chairs. Accordingly, the sling chair comprises a chair frame having two pairs of legs with a first cross member coupled to a first pair of legs and a second cross member coupled to a second pair of legs, the first cross member includes a pair of hooks fastened to the first cross member, the second pair of legs each includes an attachment point configured to receive a fastener, and a sling seat section having two frame rails each frame rail includes a pin protruding from the frame rail configured to attach to the hooks fastened to the first cross member wherein each frame rail includes another attachment point configured to receive the fastener and secure each frame rail at the another attachment point to the attachment point at each of the second pair of legs.

In accordance to another embodiment of the present invention, the another attachment point includes a threaded section and the fastener includes a bolt configured to fasten to the threaded section. During assembly, once the pins protruding from the frame rails are attached, there is some flex at the hook attachment that affords the bolts to readily line up with the threaded section of the attachment point. Without the hook attachment, bolts would be used instead. With the bolts, there would be minimal flex at the attachment which requires tighter manufacturing specs to enable the other threaded bolts to properly mate without misalignment.

In accordance to another embodiment of the present invention, the chair frame includes a right arm rest configured to couple a right side front leg and a right side back leg together and a left arm rest configured to couple a left side front leg and a left side back leg together. The arm rest provides more comfort and usability for the sling chair.

DETAILED DESCRIPTION

Figure 1:
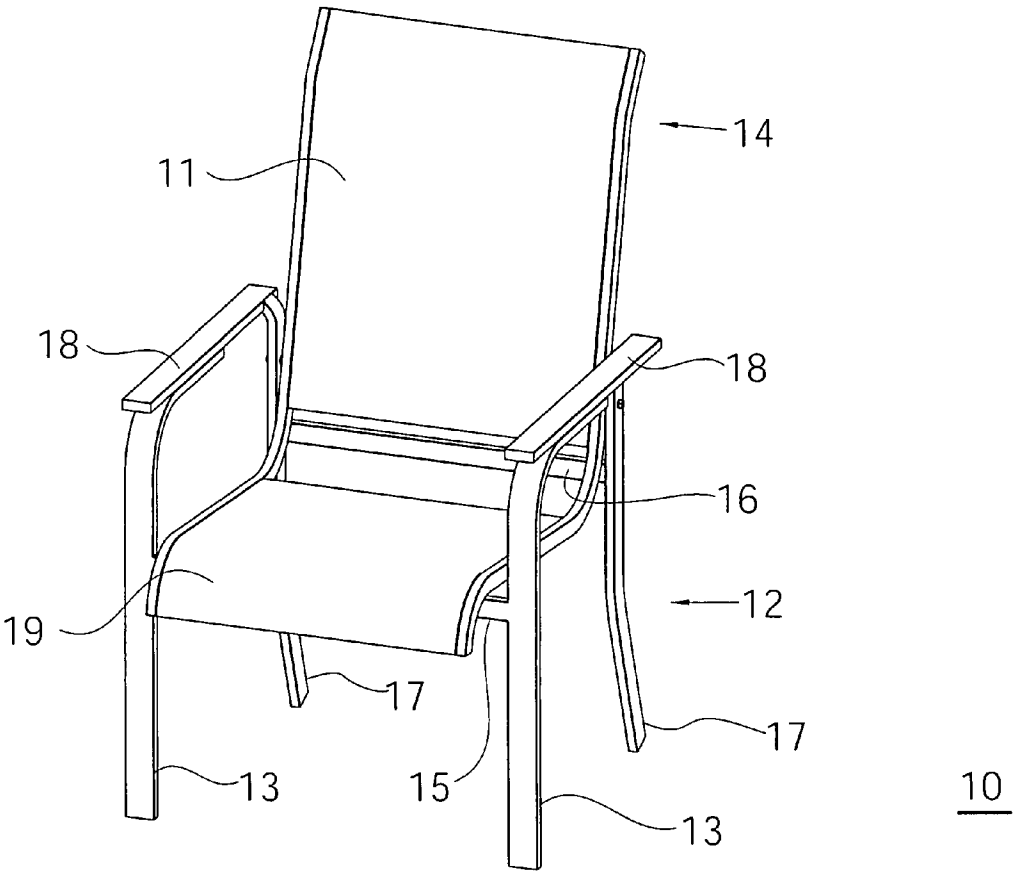
FIG. 1 illustrates a single sling chair in accordance with an embodiment of the present invention.

FIG. 1 illustrates a single sling chair 10 in accordance with an embodiment of the present invention. The single sling chair 10 includes a chair frame 12 and a sling seat section 14. The chair frame 12 includes two pairs of legs 13 and 17. The first pair of legs 13 is coupled with a first cross member 15 and the second pair of legs 17 is coupled to a second cross member 16. Generally, the frame sections of the sling chair is made using aluminum. Other metals may also be used depending on designer specification. A pair of arm rests 18 are coupled to a set of left-side legs and to a set of right-side legs. In accordance to an embodiment of the present invention, the arm rests are welded to the chair frame which includes the set of left side legs and the set of right-side legs. The sling seat section 14 is shown with a back support section 11 and a seat support section 19, although the sling seat section may include a single continuous sling encompassing both the back support section and the seat support section in a single sling. The general construction of the sling seat section 14 is conventional and well known to those skilled in the art of making sling chairs. A detailed discussion of how of the sling chair is constructed will detract from the spirit of the present invention. Accordingly, patent application entitled "Method and Apparatus for Double Sling Chair" with Ser. No. 13/136,615 is herein incorporated by reference for teaching a way to make a sling seat section 14.

Figure 2:
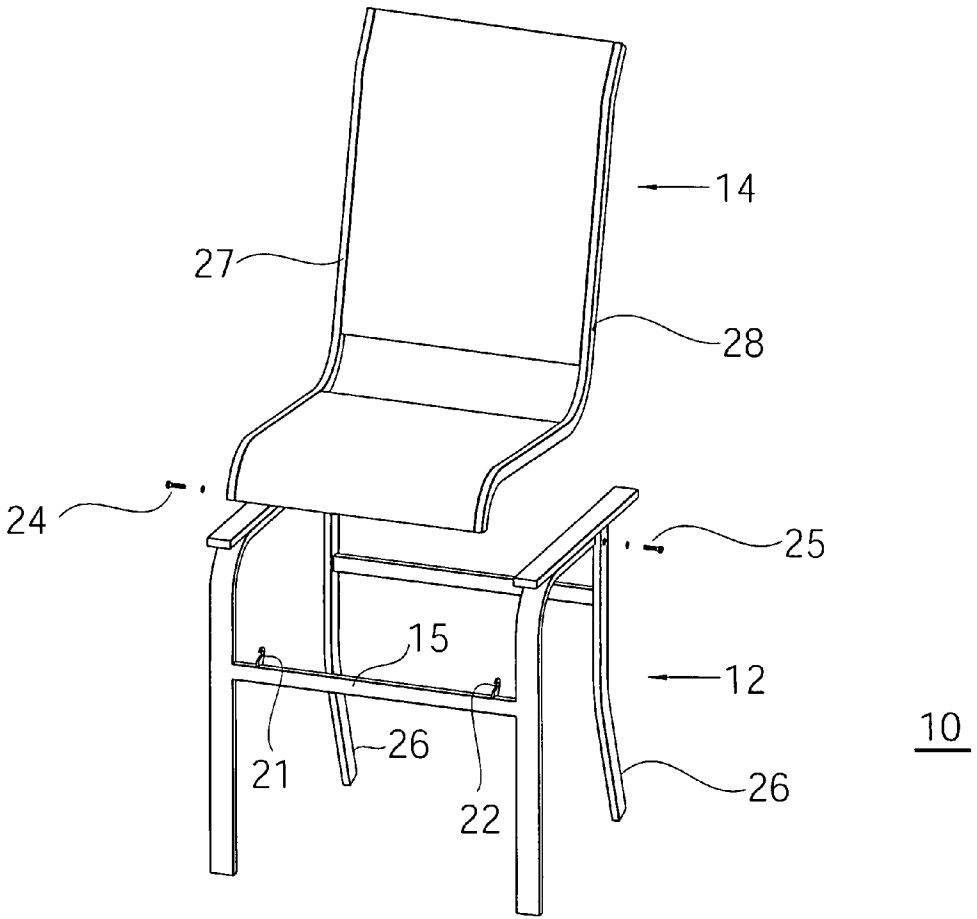
FIG. 2 illustrates a expanded view of the sling chair in accordance with an embodiment of the present invention.

FIG. 2 illustrates an expanded view of the single sling chair 10. From the expanded view, it is apparent that the single sling chair 10 has two main components: a chair frame 12 and a sling seat section 14. Generally, the sling seat section 14 is formed of a metal or wooden frame to which a piece of canvas, leather, or other flexible material is loosely fitted to provide a support surface. Also shown in FIG. 2 are hooks 21 and 22 and fastener bolts with washers 24 and 25. Although washers are shown, the washers may not be necessary. Some bolts may have built in washer like capabilities. Washers are often used to distribute the pressure of the bolt evenly over the part being secured, reducing the chance of damage to the part. Also, washers provide a smooth surface for the bolt to bear on, making it less likely to loosen as a result of an uneven fastening surface. The sling seat section 14 includes two frame rails 27 and 28. The hooks 21 and 22 are attached to the first cross member 15 and are configured to attach with protruding pins (see FIG. 3) underneath the sling seat section 14 and attached to frame rails 27 and 28. Fastener bolts 24 and 25 attach the chair frame 12 with the sling seat section 14. In particular, holes drilled through the rear pair of legs 26 of the chair frame 12 mate with matching holes in the sling seat section 14 frame rails 27 and 28. In accordance to an embodiment of the present invention, the matching holes in the sling seat section 14 of frame rails 27 and 28 include threaded holes to enable fastener bolts 24 and 25 to securely attach the chair frame 12 to the sling seat section 14.

Figure 3:
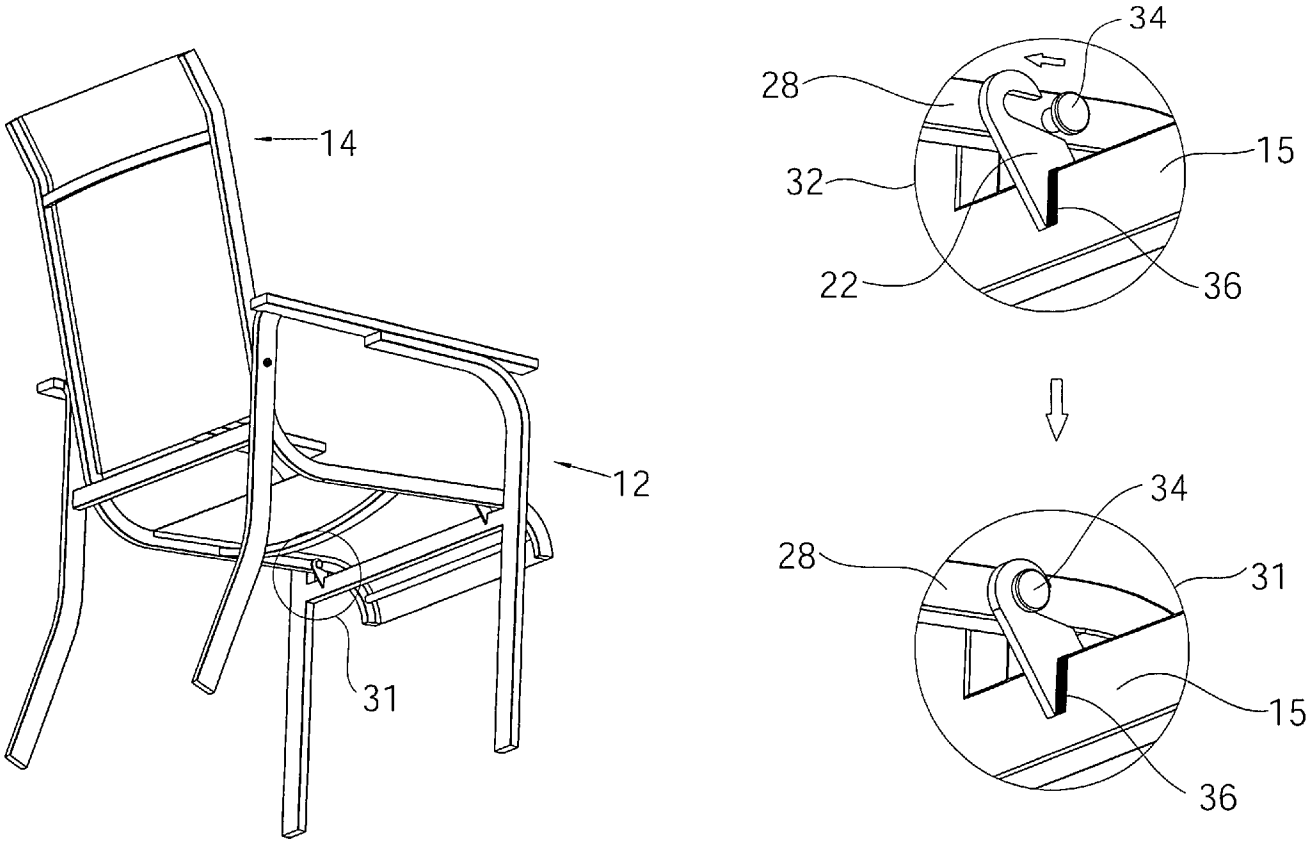
FIG. 3 illustrates a hook mechanism for the sling chair in accordance with an embodiment of the present invention.

FIG. 3 illustrates a detailed view of the hook mechanism for the sling chair in accordance with an embodiment of the present invention. With reference to enlarged views 31 and 32, a left hook mechanism for the sling chair is shown in detail. Hook 22 is attached to an angular surface 36 of the first cross member 15. The present embodiment securely attaches hook 22 to the angular surface 36 of the first cross member 15 using welds. Pin 34 attached to an interior side of frame rail 28 of the sling seat section 14 is shown protruding but not attached to hook 22 in enlarged view 32. In accordance to an embodiment of the present invention, the pin may be pressed into the frame rail and is then reinforced with welds to further secure the pin attachment with the frame rail. As the sling seat section 14 with the pin 34 is moved toward the hook, the pin 34 fastens to hook 22 as shown in enlarged view 31. The pin 34 protrudes from an interior side of the frame rail 28 and hides the hook mechanism from normal view. It should be noted that the protruding pin 32 has an enlarged or expanded head to limit lateral movement against the hook 22. Other embodiments of the present invention can locate the hooks at different fastening points. For example, the hooks may be relocated and substituted for the fastener bolts while the fastener bolts are relocated and substituted for the hooks at the front cross member. Moreover, depending on design configuration, the hooks may be relocated entirely on either the right side or the left side of the single sling chair.

The present novel hook mechanism for the single sling chair not only simplifies assembly by reducing the number of bolts or screws by half since prior designs typically required four bolts or screws, but more importantly the hook mechanism provides some degree of flexibility and movement at the hook joint so that manufacturing tolerances do not have to be as precise without jeopardizing proper alignment during assembly of the sling chair. In the past, when the hook mechanism was substituted for a bolt or screw, manufacturing tolerances had to be tighter and more precise in order to ensure proper alignment of all bolts for attachment of the chair frame to the sling seat section. Moreover, it is often the customer who must struggle when the attachment holes do not line up for the bolt to properly mate and be securely attached. As a result, bolts or the threaded holes can become cross-threaded and the chair can not be properly assembled. The resulting sling chair becomes defective and must be returned by the customer. However, by using hooks for two of the attachment points, assembly is greatly simplified. The hook mechanism provides flexibility in the joint to afford a much easier assembly process for the user. Another advantage with the hook mechanism is the reduction in parts count which further reduces manufacturing cost.

The present novel double sling invention is susceptible to minor variations and modifications that may be introduced without departing from the inventive concept. For example, the sling seat section may have a single sling construction or multiple sling construction such as a separate seat section and a separate back section. There may be multiple hook mechanisms and a single bolt attachment or multiple bolt attachments with a single hook mechanism or other combinations of hook mechanisms and bolt attachments. Even the fastening points that secure the sling chair may be located at different attachment points.

It is further appreciated that designation of furniture as fitting into categories such as chairs, lounges, and other separate and distinct varieties may be inadequate. For example, patio furniture as opposed to furniture designs may show no clear delineation separating the two categories. Moreover, alternative configurations may be within the spirit of the invention if the frame were modified resulting in furniture that can be regarded as a cot, bed, as well as a chair, lounge, sofa, or similar furniture.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Moreover, the above disclosure is not intended to limit the present invention. The scope of the present invention is defined by the claims.

I claim:

1. A sling chair comprising:

a chair frame having two pairs of legs with a first cross member coupled to a first pair of legs and a second cross member coupled to a second pair of legs, the first cross member includes a pair of hooks fastened to the first cross member, the second pair of legs each includes an attachment point configured to receive a fastener; and a sling seat section having two frame rails each frame rail includes a pin attached to the frame rail configured to attach to the hooks fastened to the first cross member wherein each frame rail includes another attachment point configured to receive the fastener and secure each frame rail at the another attachment point to the attachment point at each of the second pair of legs.

2. The sling chair of claim 1, wherein the another attachment point includes a threaded section and the fastener includes a bolt configured to fasten to the threaded section.

3. The sling chair of claim 1, wherein the chair frame includes a right arm rest configured to couple a right side front leg and a right side back leg together and a left arm rest configured to couple a left side front leg and a left side back leg together.

4. The sling chair of claim 3, wherein the right arm rest is welded to the right side front leg and the right side back leg and the left arm rest is welded to the left side front leg and the left side back leg.

5. The sling chair of claim 1, wherein each pin is attached on an interior side of the sling seat section of each frame rail.

6. The sling chair of claim 1, wherein each hook is welded to the first cross member.

7. The sling chair of claim 1, wherein each pin includes an expanded head to secure lateral movement of the sling seat section against each hook.

8. A sling chair with hook attachment comprising:

a chair frame having two pairs of legs with a first cross member coupled to a first pair of legs and a second cross member coupled to a second pair of legs, the first cross member includes a pair of hooks fastened to an angular surface of the first cross member, the second pair of legs each includes an attachment point configured to receive a fastener bolt; and a sling seat section having two frame rails each frame rail includes a pin protruding from an interior side of the frame rail configured to attach to the hooks fastened to the first cross member wherein each frame rail includes another attachment point having a threaded section configured to receive the fastener bolt and secure each frame rail at the another attachment point to the attachment point at each of the second pair of legs.

9. The sling chair with hook attachment of claim 8, wherein the pair of hooks are welded to the angular surface of the first cross member.

10. The sling chair with hook attachment of claim 8 further comprising a pair of arm rests coupled to the legs.

11. The sling chair with hook attachment of claim 8, wherein each fastener bolt includes a washer.

12. The sling chair with hook attachment of claim 8, wherein each pin includes an expanded head to limit sideways movement.

13. A hook attachment sling chair comprising:

a chair frame having four legs, a front cross member coupling two front legs, and a rear cross member coupling two rear legs, wherein the front cross member includes two hook attachments and each rear leg includes a fastener point configured to receive a fastener; and a sling seat section having two frame rails wherein each frame rail includes a pin attached to an interior side of the frame rail configured to attach to respective hooks attached to the front cross member and wherein each frame rail includes another fastener point configured receive the fastener and securely fasten each frame rail at the another fastener point with each rear leg at the fastener point.

14. The hook attachment sling chair of claim 13, wherein the fastener is a threaded bolt and the another fastener point includes a threaded section configured to receive the threaded bolt.

15. The hook attachment sling chair of claim 13, wherein the threaded bolt includes a washer.

16. The hook attachment sling chair of claim 13, wherein each hook attachment is welded to the front cross member.

17. The hook attachment sling chair of claim 13, wherein each pin is welded to an interiors side of the frame rail.

18. The hook attachment sling chair of claim 13, wherein the chair frame includes a pair of arm rests welded to the chair frame.

19. The hook attachment sling chair of claim 13, wherein each pin includes an enlarged head to limit lateral movement.

* * * * *